US006234221B1

(12) United States Patent
Clark, II

(10) Patent No.: US 6,234,221 B1
(45) Date of Patent: May 22, 2001

(54) AUTOMATIC FLUID CONTAINER REFILL DEVICE

(75) Inventor: James E. Clark, II, Santa Paula, CA (US)

(73) Assignee: C.H. & I Technologies, Inc., Santa Paula, CA (US)

( * ) Notice: Subject to any disclaimer, the term of this patent is extended or adjusted under 35 U.S.C. 154(b) by 0 days.

(21) Appl. No.: 09/530,162

(22) PCT Filed: Oct. 27, 1997

(86) PCT No.: PCT/US97/19237

§ 371 Date: Aug. 28, 2000

§ 102(e) Date: Aug. 28, 2000

(87) PCT Pub. No.: WO99/21761

PCT Pub. Date: May 6, 1999

(51) Int. Cl.[7] ..... B65B 3/10

(52) U.S. Cl. ..... 141/197; 141/46; 141/95; 141/18; 141/196

(58) Field of Search ..... 141/18, 20, 21, 141/46, 67, 95, 96, 192, 196, 197

(56) References Cited

U.S. PATENT DOCUMENTS 3,282,305 11/1966 Antolak ..... 141/5
5,293,910 * 3/1994 Mohs ..... 141/197
5,341,859 8/1994 Howseman, Jr. ..... 141/198
5,454,407 * 10/1995 Huza et al. ..... 141/197
5,901,758 * 5/1999 Hwang et al. ..... 141/197

* cited by examiner

*Primary Examiner*—J. Casimer Jacyna
(74) *Attorney, Agent, or Firm*—Christie, Parker & Hale, LLP

(57) ABSTRACT

An automatic fluid container (10) refill device. Pressure container (12) is charged with a pressurizing gas and fluid. A hydraulic cylinder (26) with an interior volume and having piston (30) located therein with an attached drive shaft (32) that extends out of the hydraulic cylinder (26) is provided. Drive (32) has gear rack (40) located thereon. Hydraulic cylinder (26) has hydraulic fluid inlets (28, 36) provided at first and second ends thereof. Fluid conduit (24) connects between pressure container (12) and first hydraulic fluid inlet (28). A valve (44) has a fluid inlet (46) and outlet (48). Geared sprocket (42) is mounted on valve (44) and is operable for opening and closing valve (44). Gear rack (40) on drive shaft (32) is engaged with and operates geared sprocket (42). Fluid supply pipe (50) is connected to fluid inlet (46) and carries fluid from a source of fluid through valve (44). Fluid junction (38) is in fluid communication with fluid outlet (48) of valve (44). Second fluid tube (34) connects fluid junction (38) and a second hydraulic fluid inlet (36). Fluid fill tube (56) connects fluid junction (38) to a fluid container (58) to be filled.

7 Claims, 3 Drawing Sheets

Valve Open

Valve Closed

AUTOMATIC FLUID CONTAINER REFILL DEVICE

FIELD OF THE INVENTION

The invention relates generally to the field of fluid storage and delivery and more particularly to devices and systems for the automatic delivery and shutoff of fluids during the process of filling pressure containers.

BACKGROUND OF THE INVENTION

Sealed pressure containers such as approved by the U.S. Department of Transportation (DOT) are gaining popularity as vessels for storing and delivering fluids. Some of the advantages gained by using pressure containers include enhanced health and safety since DOT pressure containers resist slitting and leakage, decreased environmental impact due to a lower probability of fluid being inadvertently released from sealed pressure container, more efficient fluid transfer capabilities between the container and the destination of the fluid (e.g. an automobile or other machine), and lower costs due to reusability of the pressure containers.

It is possible to place a charge of a gas, such as nitrogen or carbon dioxide, in a pressure container as a propellant, and use the propellant gas to dispense the fluid without pumps. Using a propellant gas has advantages because, particularly in the case where the propellant is an inert gases, the propellant provides an extra degree of fire safety, and largely eliminates the need for pumps and electronics.

In the case of pressure containers with inert gas propellant, it is desirable that during filling of the container with fluid, propellant gas is not allowed escape, otherwise the container will have an insufficient charge of propellant gas to delivery the fluid and will need to be recharged In this respect, filling pressure containers with fluid without the propellant gas escaping, can be a time-consuming and labor-intensive task. Generally, fluids are delivered from a larger container under high-pressure to a smaller pressure container under lower pressure. The transfer of fluid is typically accomplished utilizing pumps or other means. Often, the pumps that are used to transfer the fluid do so in pulsating, high-pressure spurts. Various means can be employed to ensure that the correct volume of fluid is delivered, and to prevent over or under filling of the pressure container with fluid. For example, systems that deliver a predetermined volume of fluid, such as by using fluid meters, are appropriate where the pressure container is known to be empty. Other systems utilize weighing systems that control a fluid valve to automatically shut off fluid flow when the container reaches a certain desired weight. These systems are not ideal because they require costly and sensitive meters, pumps, and electronics, and have reliability problems.

Therefore, there remains a need for an improved automatic pressure container filling valve/system which can be used to automatically and reliably control the flow of fluids from any fluid source, even under high and pulsating irregular pressure, to a pressure container under a gas blanket, to thereby fill the pressure container with the fluid until the propellant gas in the pressure container reaches a predetermined pressure.

DETAILED DESCRIPTION OF THE PREFERRED EMBODIMENTS

Figure 1:
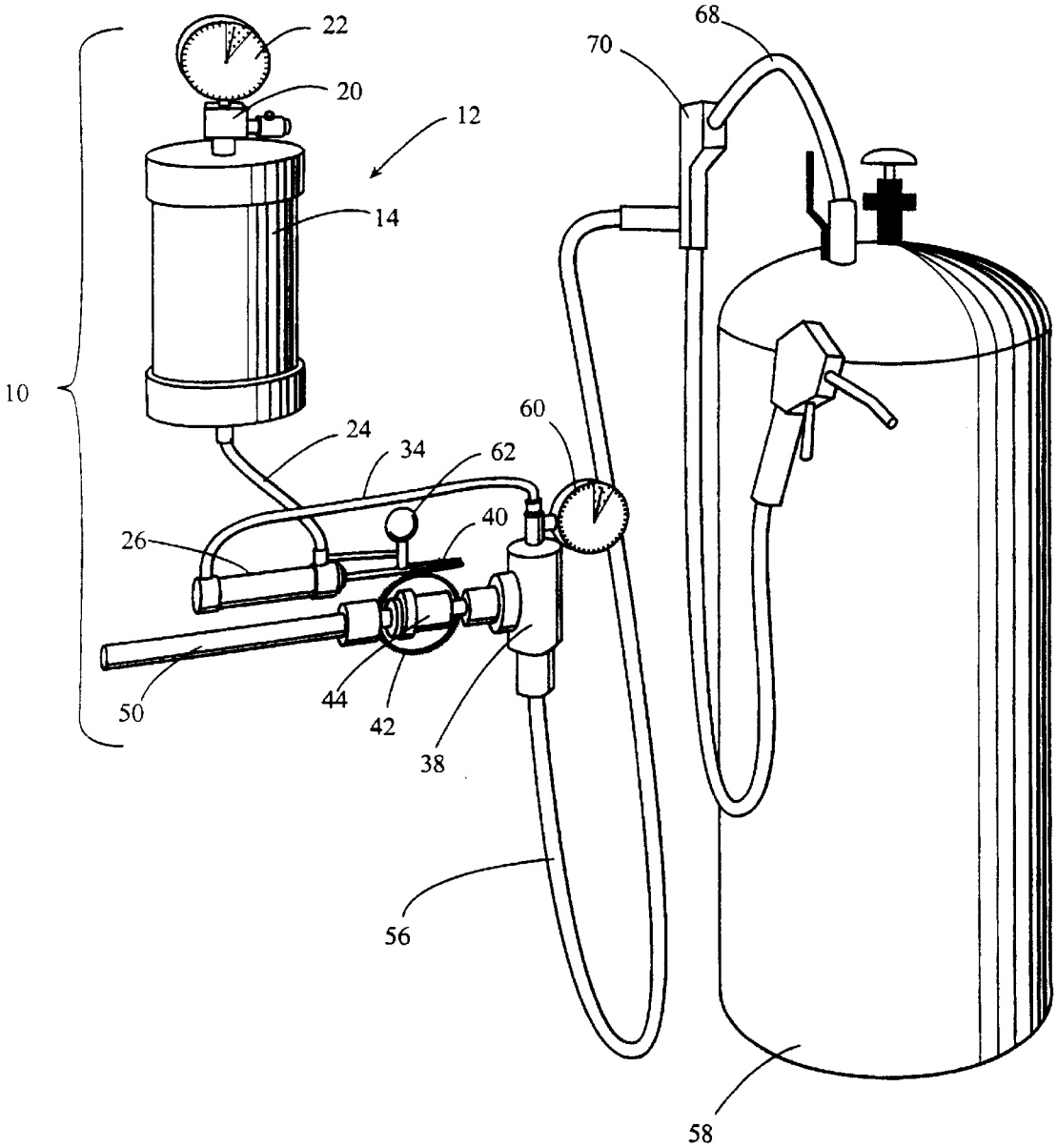
FIG. 1 is a perspective view of the device of the invention connected to a pressure container adapted to be filled with fluid.
Figure 2:
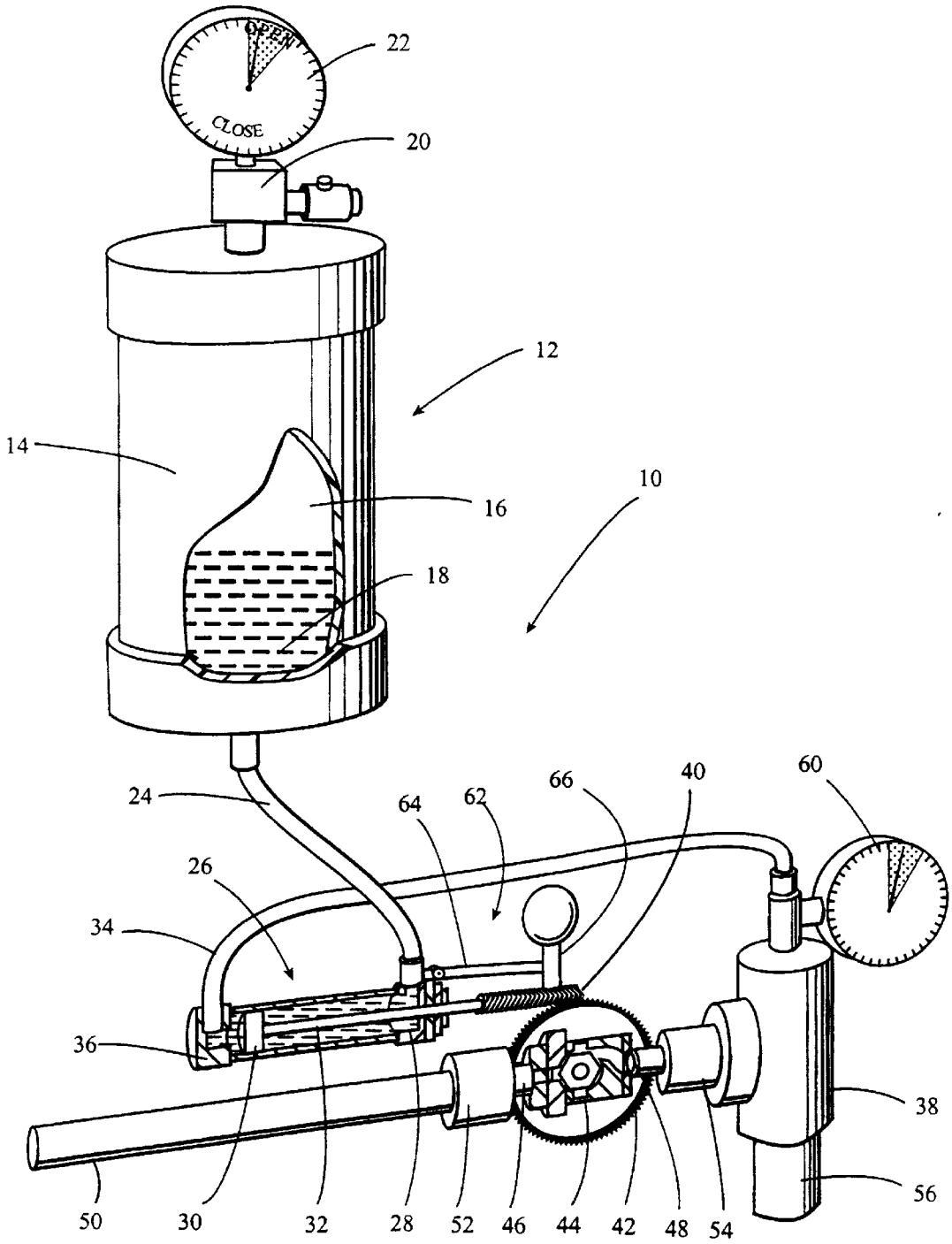
FIG. 2 is a side view of the device, with the valve in the open position.

The device 10 of the invention includes a memory unit 12. Memory unit 12 includes a sealed pressure vessel 14 having a predetermined interior volume 16, and preferably with a small and predetermined amount of liquid 18 (e.g. oil) contained therein. The reason for this is that liquids are less likely to leak from hydraulic cylinders than are gases, are much less compressible under pressure, and thus are far more reliable. Memory unit 12 has a gas inlet valve 20 to permit gas to be introduced and pressurize the interior volume 16 and fluid 18 contained in memory unit 12. A pressure gauge 22 is in communication with memory unit 12. Pressure gauge 22 indicates the "open" and "close" pressure, as will be discussed below. A small fluid tube 24 is in fluid connection between the bottom of memory unit 12 and a hydraulic cylinder 26 at a right side 28. Pressure gauge 22 provides a visual indication of the pressures at which fluid will flow into sealed pressure container 58 (open) and the pressures at which fluid flow will stopped (close), indicating sealed pressure container 58 is full. The pressurizing gas is preferably an inert gas.

Figure 3:
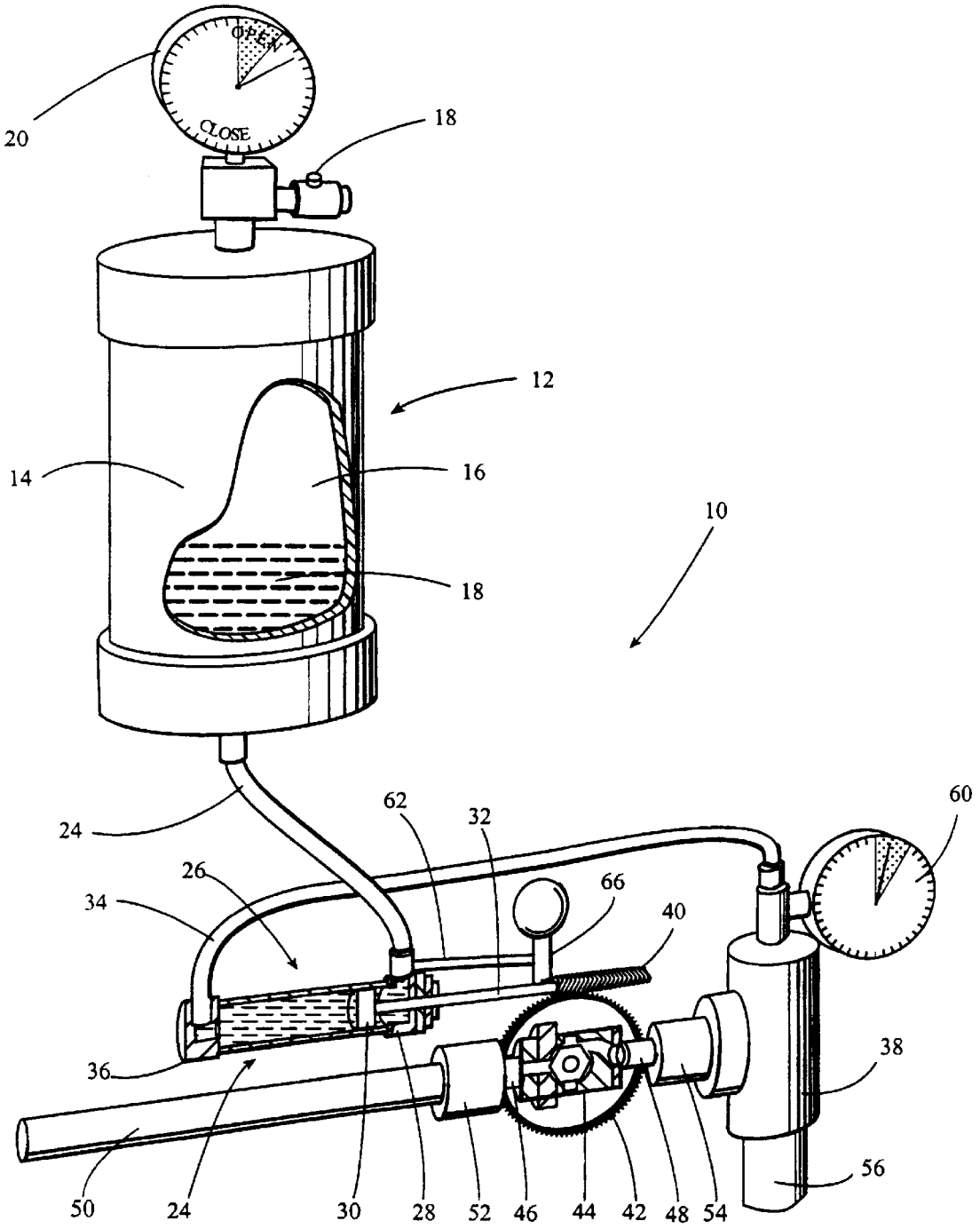
FIG. 3 is a side view of the device, with the valve in the closed position.

Hydraulic cylinder 26 has a fluid tight piston 30 with a push rod 32 located therein. A second hydraulic fluid tube 34 is connected to hydraulic cylinder 26 at hydraulic cylinder's left side 36. Second hydraulic fluid tube 34 connects to and is in fluid communication with a downstream fluid junction means, for example, in the form of a T-fitting 38. Push rod 32 has a first engagement means located at its distal end, such as gear rack 40. Alternately, other engagement means can be provided. Gear rack 40 rides on a geared sprocket 42. Geared sprocket 42 is connected to and is adapted to open and close a fluid valve 44 (such as a ball valve). Alternatively, gear rack 40 and sprocket gear 42 can be replaced with other known coupling means, which would allow movement of piston 30 in hydraulic cylinder 26 to operate valve 44. Valve 44 has a fluid/air inlet side 46, and a fluid outlet side 48. Fluid to be fed into a sealed pressure container 58 to be filled is fed to fluid/air inlet side 46 of valve 44 via fluid supply line 50. Fluid supply line 50 is in turn connected to a larger source of fluid, e.g. a tanker truck supplying the fluid via pumps (not shown.) Fluid/air inlet side 46 and outlet sides 48 preferably have reducers 52 and 54, respectively, to reduce fluid pressure fluctuation and spurts through valve 44. Fluid travels through valve 44 and exits outlet side 48 and enters T-fitting 38. As best shown in FIG. 1, a fluid fill hose 56 is adapted to carry fluid to sealed pressure container 58 to be filled. Optionally, a pressure valve 60 can be positioned on T-fitting 38 to monitor the fluid pressure in T-fitting 38 (and thus the fluid pressure in sealed pressure container 58.) An additional safety feature is provided as follows. A locking mechanism 62 can preferably be provided to automatically maintain valve 44 in a closed position when sealed pressure container 58 is filled with fluid. One such locking mechanism 62 is shown, and comprises a pivoted catch arm 64 with a locking head 66, wherein head 66 slideably rides on and does not engage with gear rack 40 until gear rack 40 is positioned to the right, thereby turning sprocket 42 clockwise (and thus closing valve 44.) At this position, head 64 will be resting behind gear rack 40 (or on a locking point of gear rack 40, not shown) and thus prevent gear rack 40 from further turning geared sprocket 42, and thus not allowing fluid valve 44 from being inadvertently opened, as best shown in FIG. 3.

In operation, the device 10 functions as follows. As fluid enters the system from fluid/area inlet side 46, and travels through valve 44, and into the fluid egress side 48, there will be a pressure drop due to constriction of the inner diameter of the tubing and reduced size of the interior diameter of valve 44.

Referring to FIG. 1, fluid fill hose 56 connects to a sealed pressure container 58 via hose 68. For convenience, fluid fill hose 56 can have a hydraulic fitting 70 for connection to a fluid filling fitting 70 connected to hose 68. Fluid filling fitting 70 preferably incorporates a device to prevent any fluid or volume of the blanket of propellant gas in sealed pressure container 58 from escaping. Sealed pressure container 58 is adapted for holding a liquid, such as hydraulic or motor oil, and a blanket of pressurized propellant gas, preferably an inert gas, such as nitrogen. As fluid flows out through valve 44, through T-fitting 38, and hose 56, and into sealed pressure container 58, the pressure of the propellant gas in sealed pressure container 58 will increase due to the decreased gas volume area available. For example, sealed pressure container 58, when empty, will be charged with about 20 P.S.I. of nitrogen gas. When sealed pressure container 58 is about 80 to 90 percent full, the nitrogen gas pressure might jump to about 80 to a 100 P.S.I. This pressurizes the fluid in hose 56 during the filling process. This pressure is experienced in the fluid in T-fitting 38 and second hydraulic fluid tube 34 connected to the left side 36 of hydraulic cylinder 26. As previously noted, there is fluid in memory unit 12 under a predetermined pressure, which fluid is in fluid communication with right side 28 of hydraulic cylinder 26. When the pressure of the fluid in second hydraulic fluid line 34 and present in left side of hydraulic cylinder 26 exceeds that of the pressurized fluid coming through tube 24 from memory unit 12 into night side 28 of hydraulic cylinder 26, the fluid tight piston 30 moves. This movement thereby moves gear rack 40, which rides on geared sprocket 42, connected to valve 44. At the appropriate pressures, valve 44 will open and close, providing an automatic shut off mechanism to control fluid flow into sealed pressure container 58.

In practice, by providing memory unit 12 with an interior volume of about 100 times that of hydraulic cylinder 26, device 10 works very accurately and provides sufficient torque necessary to close valve 44. In operation of device 10, at a predetermined fluid pressure, in sealed fluid container 58, piston 30 will push gear rack 40 smoothly and quickly to slide close valve 44, and locking mechanism 62 will prevent valve 44 from being reopened unless purposely reset by a user.

This new invention represents an important improvement to the art because it allows sealed pressure fluid containers under propellant gas blanket to be refilled in a safe and effective manner from high pressure fluid sources of fluid, such as tanks of fluid fed under higher pressure pulses, and automatically shuts off the fluid flow when the container is fill.

The drawings and the foregoing description are not intended to represent the only form of the invention in regard to the details of its methodology and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

What is claimed is:

1. An automatic fluid container refill device, comprising:

a pressure container adapted to be charged with a pressurizing gas;

a hydraulic cylinder with an interior volume, the hydraulic cylinder having hydraulic fluid inlets provided at first and second ends of the hydraulic cylinder, the pressure container having a larger interior volume than the interior volume of the hydraulic cylinder, a piston slideably located in the hydraulic cylinder, the piston having an attached drive shaft that extends out of the hydraulic cylinder, the drive shaft having first engagement means located thereon,;

a fluid conduit connecting the pressure container to the hydraulic fluid inlet at the first end of the hydraulic cylinder, a valve means having a fluid inlet and fluid outlet;

second engagement means mounted on the valve means and operable for opening and closing the valve means, wherein the first engagement means on drive shaft is adapted to engage with and operate second engagement means;

a fluid supply pipe connected to the inlet of the valve means and adapted for carrying fluid from a source of fluid through the valve means;

a fluid junction means in fluid communication with the fluid outlet of the valve means;

a second fluid tube connecting the fluid junction means and the second end of the hydraulic cylinder; and a fluid fill tube connecting the fluid junction means and adapted for attachment to a fluid container.

2. The automatic fluid container refill device of claim 1, wherein the pressure container has liquid contained therein.

3. The automatic fluid container refill device of claim 1, wherein the pressure container has an interior volume about 100 times larger than the interior volume of the hydraulic cylinder.

4. The automatic fluid container refill device of claim 1, wherein the first engagement means located on the drive shaft comprises a gear rack, and the second engagement means on the valve means comprises a geared sprocket.

5. The automatic fluid container refill device of claim 1, wherein the valve means comprises a ball valve.

6. The automatic fluid container refill device of claim 1, further comprising a safety lock means to prevent valve means from being opened.

7. The automatic fluid container refill device of claim 1, further comprising pressure reducers located at the fluid inlet and fluid outlet of the valve means.

* * * * *

UNITED STATES PATENT AND TRADEMARK OFFICE

CERTIFICATE OF CORRECTION

PATENT NO. : 6,234,221 B1
DATED : May 22, 2001
INVENTOR(S) : James E. Clark II

It is certified that error appears in the above-identified patent and that said Letters Patent is hereby corrected as shown below:

Title page,
ABSTRACT,
Line 6, replace "Drive (32)" with -- Drive shaft (32) --.

Signed and Sealed this

Twenty-eighth Day of May, 2002

*Attest:*

*Attesting Officer*

JAMES E. ROGAN
*Director of the United States Patent and Trademark Office*